US005729840A

United States Patent [19]

Wu

[11] Patent Number: 5,729,840

[45] Date of Patent: Mar. 24, 1998

[54] INFLATABLE ARTICLE

[75] Inventor: Hsin-Tsai Wu, Taipei, Taiwan

[73] Assignee: Bulton Enterprises Co., Ltd., Taipei, Taiwan

[21] Appl. No.: 721,413

[22] Filed: Sep. 26, 1996

[51] Int. Cl.[6] ..... A47K 3/064

[52] U.S. Cl. ..... 4/588; 441/40; 114/345

[58] Field of Search ..... 4/488, 506, 585, 4/588, 590; 441/40; 114/345

[56] References Cited

U.S. PATENT DOCUMENTS

| | | | |
|---|---|---|---|
| 3,931,652 | 1/1976 | Navarra | 4/588 |
| 4,547,919 | 10/1985 | Wang | 4/506 |
| 4,964,183 | 10/1990 | LaForce, Jr. | 4/588 |

*Primary Examiner*—Jesus D. Sotelo
*Attorney, Agent, or Firm*—Panitch Schwarze Jacobs & Nadel, P.C.

[57] ABSTRACT

An inflatable article made of impervious flexible material includes a top sheet, a bottom sheet, an inner sheet and an outer sheet that confine a looped air receiving space. The top sheet includes a seat portion sized to seat at least one person thereon. The inflatable article further includes at least one dividing wall disposed between the top sheet and the bottom sheet and dividing the air receiving space into at least two compartments, and at least two vertical partition walls disposed in each of the compartments immediately below the seat portion. Each of the vertical partition walls has a top edge sealed to one of the top sheet and the dividing sheet, and a bottom edge sealed to one of the dividing sheet and the bottom sheet. The vertical partition walls define at least one chamber that is in fluid communication with a corresponding one of the upper and lower compartments.

5 Claims, 5 Drawing Sheets

INFLATABLE ARTICLE

BACKGROUND OF THE INVENTION

1. Field of the Invention

The invention relates to an inflatable article, more particularly to an inflatable wading pool for children, or the like, that has a firm and stable structure, that is suitable for large-sized construction, and that provides a seat portion for seating at least one person thereon.

2. Description of the Related Art

Referring to FIG. 1, a conventional inflatable pool 1 includes an annular side wall that consists of three interconnected and superimposed annular air columns 10. The air columns 10 cooperatively confine a pool and have a top edge and/or a bottom edge that is sealed to the bottom edge or top edge of an adjacent one of the air columns 10. Since the side wall of the conventional inflatable pool 1 is constructed by edge-connection among the air columns 10, the side wall may easily twist or break due to the water pressure that is applied to the side wall. Moreover, the conventional inflatable pool 1 does not provide a seat on the side wall thereof for a person to sit thereon.

FIGS. 2 and 3 illustrate another conventional inflatable pool 2 which is shaped as an elongated loop and which includes a side wall unit that consists of three interconnected and superimposed looped air columns 20. The air columns 20 have upper and lower surfaces that are sealed to each other. The top surface of the side wall unit includes a wider portion which serves as a seat portion 21. A plurality of connecting members 211 are mounted on the top surface and the bottom surface in each of the air columns 20 immediately below the seat portion 21. Each of the air columns 20 is provided with a plurality of connecting cords 212, each of which interconnects an upper one of the connecting members 211 and a lower one of the connecting members 211 to form a continuous zigzag line. The connecting cords 212 impart rigidity to the seat portion 21 for supporting a person seated on the seat portion 21. However, the number of the connecting members 211 must be relatively large to impart sufficient rigidity to the seat portion 21. Thus, mounting of the connecting cords 212 on the connecting members 211 is a complicated and labor-consuming task in view of the large number of connecting members 211 that are in use. Accordingly, the manufacturing cost is thereby increased.

SUMMARY OF THE INVENTION

Therefore, the main object of this invention is to provide an inflatable article which has a firm and stable structure and which is suitable for large-sized construction.

Another object of the present invention is to provide an inflatable article that has a durable seat portion for seating at least one person thereon.

Accordingly, the inflatable article of the present invention is made of impervious flexible material and includes a top sheet, a bottom sheet, a looped inner sheet, a looped outer sheet, at least one dividing sheet and at least four vertical partition walls.

The top sheet is formed as a closed loop and has outer and inner peripheral edges. A seat portion is provided on the top sheet between at least a section of the outer and inner peripheral edges. The seat portion has a size sufficient for seating at least one person thereon. The bottom sheet is disposed below the top sheet and has a peripheral edge. The looped outer sheet has a top edge sealed to the outer peripheral edge of the top sheet and a bottom edge sealed to the peripheral edge of the bottom sheet. The looped inner sheet has a top edge sealed to the inner peripheral edge of the top sheet and a bottom edge sealed to the bottom sheet. The inner sheet and the bottom sheet cooperatively confine a water receiving space. The top and bottom sheets and the outer and inner sheets cooperatively confine an air receiving space thereamong. Each dividing sheet is disposed in the air receiving space between the top and bottom sheets. The dividing sheet is substantially similar in shape to the top sheet and has an inner peripheral edge sealed to the inner sheet and an outer peripheral edge sealed to the outer sheet. The dividing sheet divides the air receiving space into at least two compartments that include an upper compartment and a lower compartment. At least two of the vertical partition walls are disposed in each of the upper and lower compartments immediately below the seat portion of the top sheet. Each of the partition walls has a top edge sealed to one of the top sheet and the dividing sheet, and a bottom edge sealed to one of the dividing sheet and the bottom sheet. The partition walls in each of the upper and lower compartments define at least one chamber that is in fluid communication with a corresponding one of the upper and lower compartments.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 4:
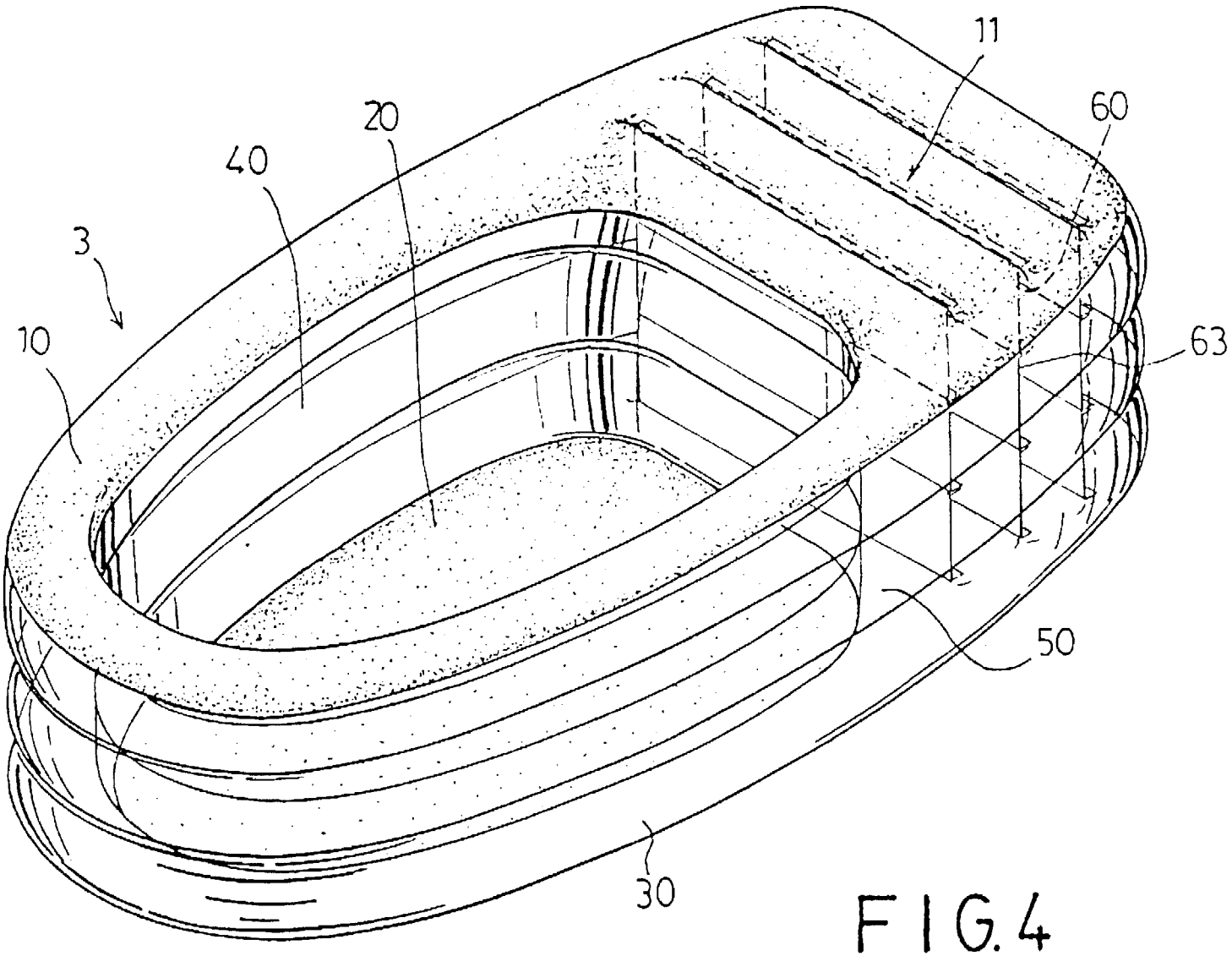
FIG. 4 is a perspective view of a preferred embodiment of the inflatable article according to the present invention.
Figure 5:
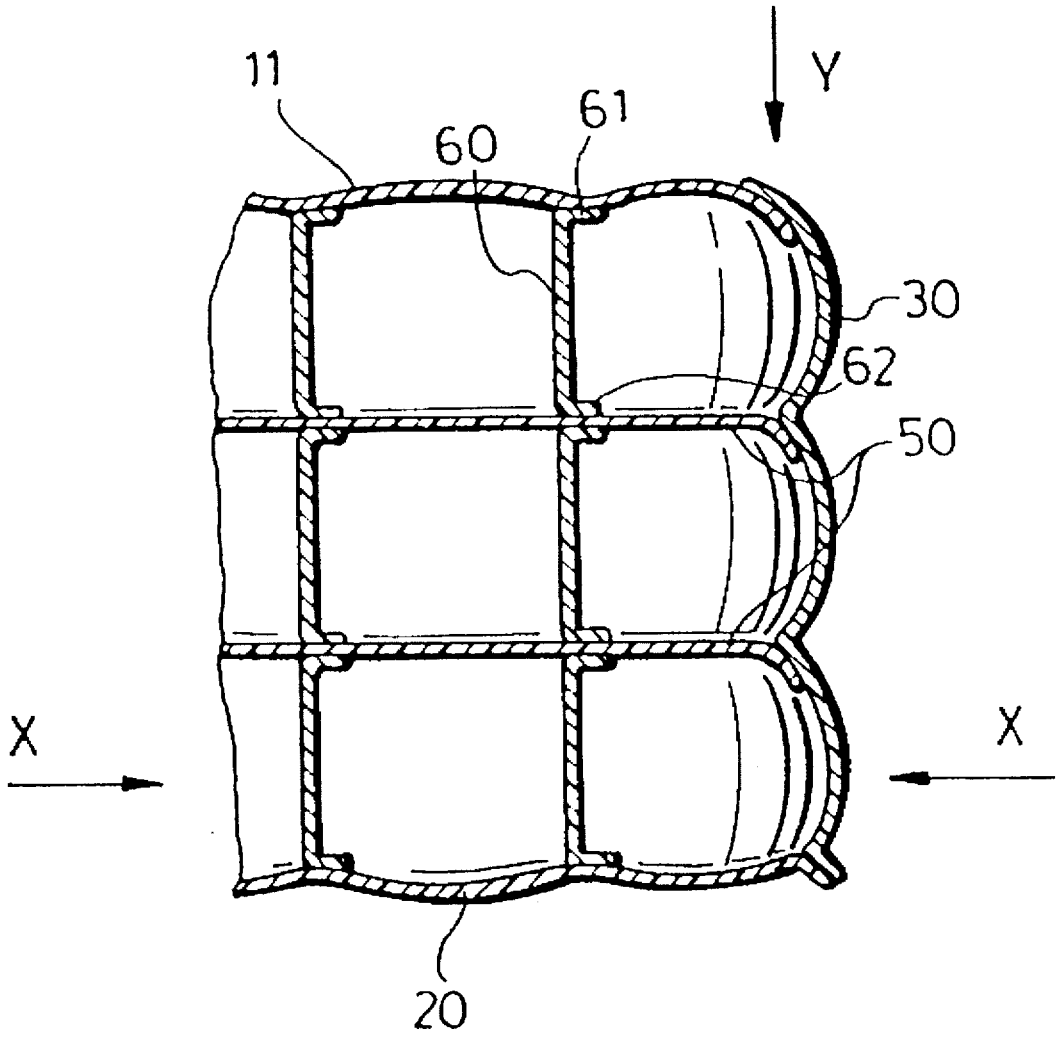
FIG. 5 is a cross-sectional view illustrating the seat portion of the inflatable article of FIG. 4.

Referring to FIGS. 4 and 5, the inflatable article according to the present invention is embodied in an inflatable pool which includes a top sheet 10, a bottom sheet 20, a looped outer sheet 30, a looped inner sheet 40, two dividing sheets 50 and a plurality of vertical partition walls 60. The top sheet 10 is formed as a closed loop and has outer and inner peripheral edges, and a seat portion 11 between at least a section of the outer and inner peripheral edges. The seat portion 11 has a size sufficient for seating at least one person thereon. The bottom sheet 20 is disposed below the top sheet 10 and has a peripheral edge. The looped outer sheet 30 has a top edge sealed to the outer peripheral edge of the top sheet 10 and a bottom edge sealed to the peripheral edge of the bottom sheet 20. The looped inner sheet 40 has a top edge sealed to the inner peripheral edge of the top sheet 10 and a bottom edge sealed to the bottom sheet 20. The inner sheet 40 and the bottom sheet 20 cooperatively confine a water receiving space. The top and bottom sheets 10, 20 and the outer and inner sheets 30, 40 cooperatively confine an air receiving space thereamong. The two dividing sheets 50, which include an upper one and a lower one, are disposed in the air receiving space between the top and bottom sheets 10 and 20 and are parallel to each other. Each of the dividing sheets 50 is substantially similar in shape to the top sheet 10 and has an inner peripheral edge sealed to the inner sheet 40 and an outer peripheral edge sealed to the outer sheet 30. The two dividing sheets 50 divide the air receiving space into three compartments that include an upper compartment, an intermediate compartment and a lower compartment. In this embodiment, each of the three compartments is provided with three vertical partition walls 60 that are disposed immediately below the seat portion 11 of the top sheet 10 and that have a height conforming with the height of the corresponding compartment. Each of the partition walls 60 disposed in the upper compartment has a top edge 61 sealed to the top sheet 10 and a bottom edge 62 sealed to the upper dividing sheet 50. Each of the partition walls 60 disposed in the intermediate compartment has a top edge 61 sealed to the upper dividing sheet 50 and a bottom edge 62 sealed to the lower dividing sheet 50. Each of the partition walls 60 disposed in the lower compartment has a top edge 61 sealed to the lower dividing sheet 50 and a bottom edge 62 sealed to the bottom sheet 20. The partition walls 60 in the upper compartment are respectively aligned with the partition walls 60 in the intermediate and lower compartments. The partition walls 60 are substantially parallel to the section of the outer and inner peripheral edges of the top sheet 10 that define the seat portion 11 therebetween. Each of the partition walls 60 has opposite vertical edges 63 that are spaced from the outer sheet 30 so as to define passages therewith. The partition walls 60 in each of the compartments define two chambers that are in fluid communication with a corresponding one of the compartments.

This embodiment is shown to include two dividing sheets 50 and three partition walls 60 in each of the compartments. The present invention, however, should not be limited to the preferred embodiment since the presence of one dividing wall and two partition walls in each compartment is also possible.

Figure 1:
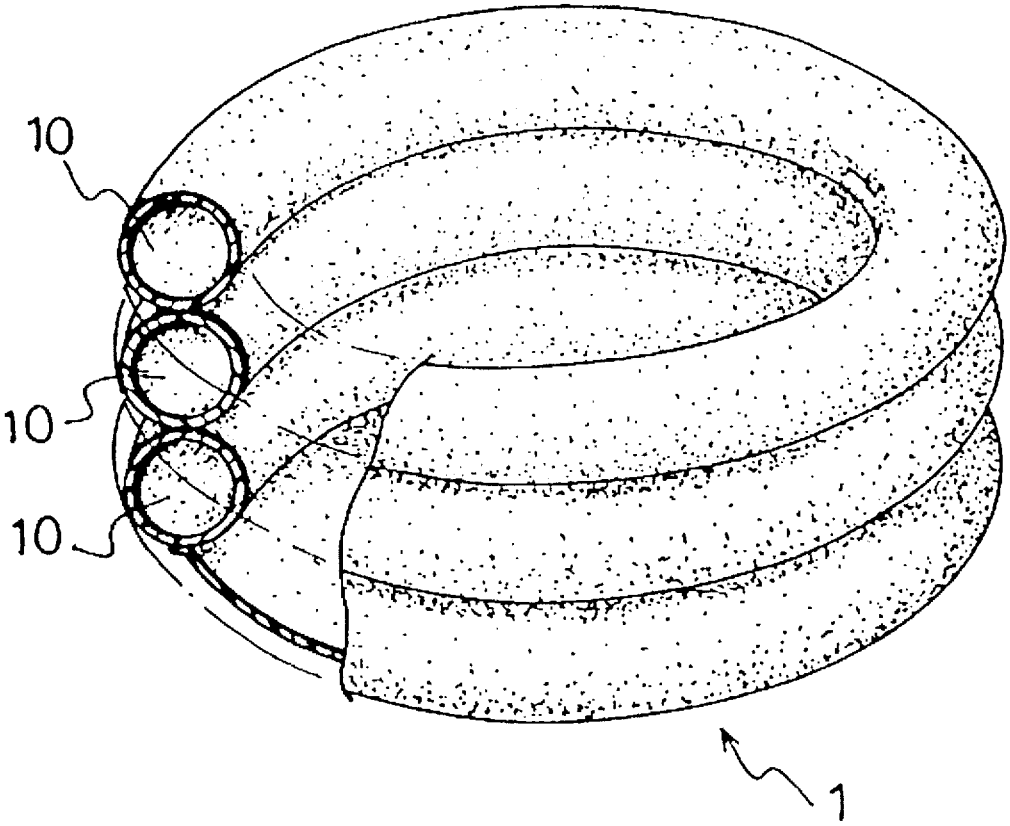
FIG. 1 (PRIOR ART)
FIG. 1 is a partly sectional perspective view illustrating a conventional inflatable pool.
Figure 2:
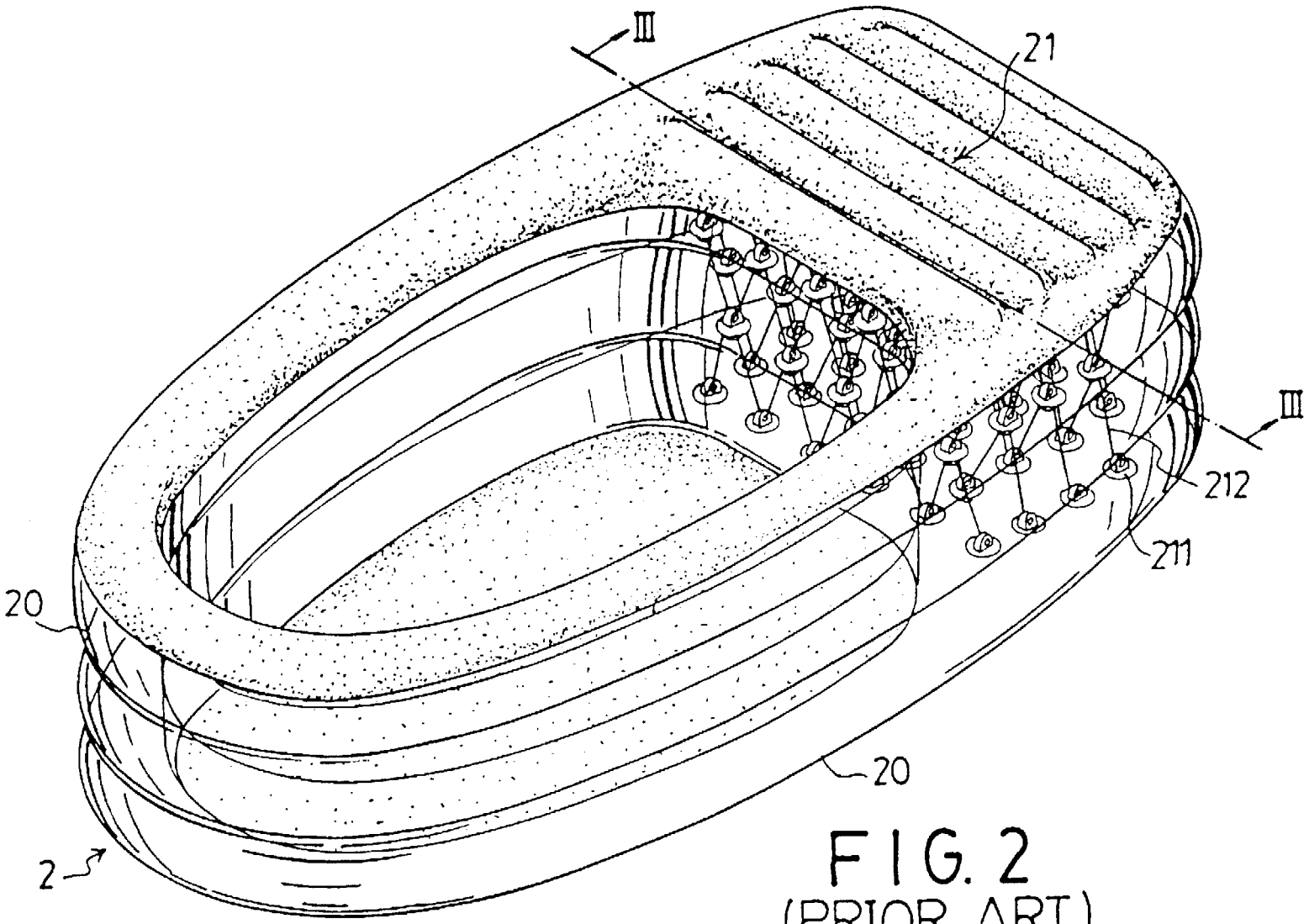
FIG. 2 (PRIOR ART)
FIG. 2 is a perspective view illustrating another conventional inflatable pool.
Figure 3:
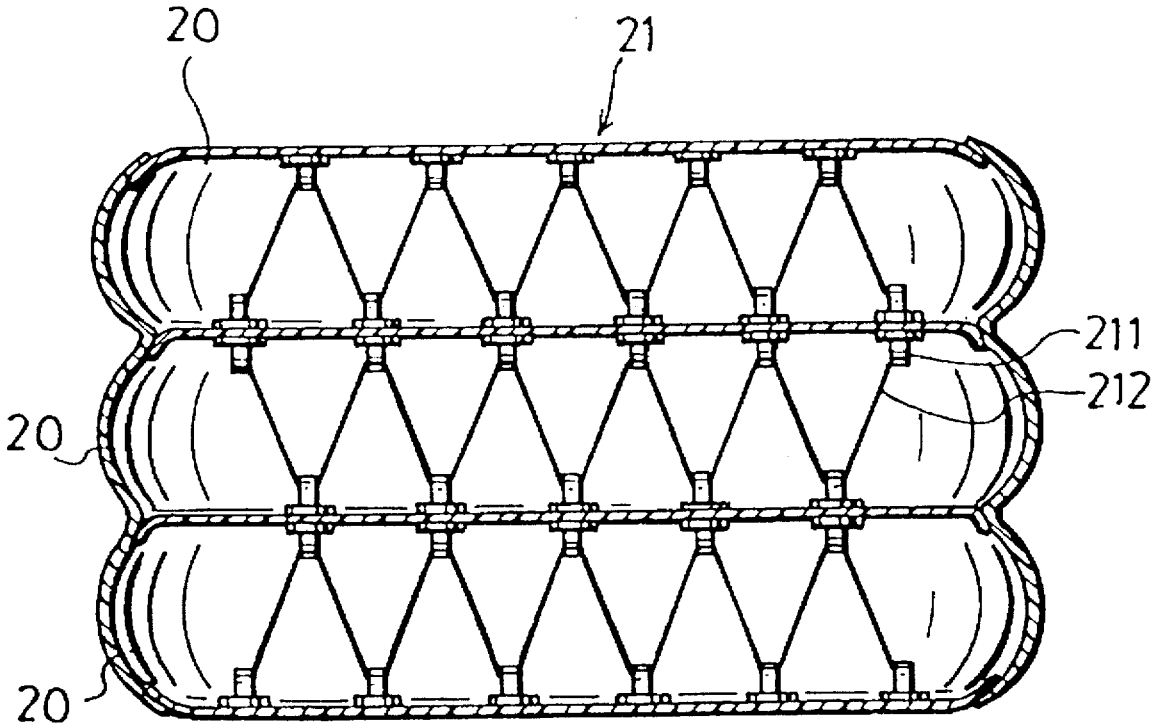
FIG. 3 (PRIOR ART)
FIG. 3 is a cross-sectional view illustrating the seat portion of the inflatable pool of FIG. 2.

The connection of the dividing sheets 50 and the partition walls 60 to the top and bottom sheets 10, 20 and the outer and inner sheets 30, 40 may be accomplished by means of well known high frequency sealing techniques. The inner edges of the dividing sheets 50 are at first heat sealed to the inner sheet 40. The top edges and the bottom edges of the partition walls 60 are then heat sealed respectively to the top sheet 10, the dividing sheets 50 and the bottom sheet 20. Subsequently, the outer edges of the dividing sheets 50 are heat sealed to the outer sheet 30. The connection of the partition walls 60 may be accomplished through the use of machines. Therefore, man-made defects which occur in the manufacturing of the conventional inflatable pool as shown in FIGS. 2 and 3 can be avoided and a cost-efficient manufacturing process can be achieved.

Referring to FIG. 5, when pressure is applied along an X direction or Y direction, the force is distributed uniformly by the vertical partition walls 60 to the dividing sheets 50, the outer sheet 30 and the bottom sheet 20. By the use of the partition walls 60, the seat portion 11 will be supported by the many chambers which are filled with air after the article of this invention is inflated. Therefore, the inflatable pool according to the present invention has a firmer and more stable structure than the conventional ones.

With this invention thus explained, it is apparent that numerous modifications and variations can be made without departing from the scope and spirit of this invention. It is therefore intended that this invention be limited only as indicated in the appended claims.

I claim:

1. An inflatable article made of impervious flexible material, comprising:

a top sheet which is formed as a closed loop and which has outer and inner peripheral edges and a seat portion between at least a section of said outer and inner peripheral edges, said seat portion having a size sufficient for seating at least one person thereon;

a bottom sheet below said top sheet, said bottom sheet having a peripheral edge;

a looped outer sheet having a top edge sealed to said outer peripheral edge of said top sheet and a bottom edge sealed to said peripheral edge of said bottom sheet;

a looped inner sheet having a top edge sealed to said inner peripheral edge of said top sheet and a bottom edge sealed to said bottom sheet, said inner sheet and said bottom sheet cooperatively confining a water receiving space;

said top and bottom sheets and said outer and inner sheets cooperatively confining an air receiving space thereamong;

at least one dividing sheet disposed in said air receiving space between said top and bottom sheets, said dividing sheet being substantially similar in shape to said top sheet, said dividing sheet having an inner peripheral edge sealed to said inner sheet and an outer peripheral edge sealed to said outer sheet, said dividing sheet dividing said air receiving space into at least two compartments that include an upper compartment and a lower compartment; and at least two vertical partition walls disposed in each of said upper and lower compartment immediately below said seat portion of said top sheet, each of said partition walls having a top edge sealed to one of said top sheet and said dividing sheet, and a bottom edge sealed to one of said dividing sheet and said bottom sheet, said partition walls in each of said upper and lower compartments defining at least one chamber that is in fluid communication with a corresponding one of said upper and lower compartments.

2. The inflatable article as claimed in claim 1, wherein said partition walls in said upper compartment are respectively aligned with said partition walls in said lower compartment.

3. The inflatable article as claimed in claim 1, wherein each of said partition walls is substantially parallel to said section of said outer and inner peripheral edges of said top sheet.

4. The inflatable article as claimed in claim 2, wherein each of said partition walls is substantially parallel to said section of said outer and inner peripheral edges of said top sheet.

5. The inflatable article as claimed in claim 1, wherein each of said partition walls has opposite vertical edges that are spaced from said outer sheet so as to define passages therewith.

* * * * *